US006976496B2

(12) United States Patent
Cantrell et al.

(10) Patent No.: US 6,976,496 B2
(45) Date of Patent: Dec. 20, 2005

(54) METHOD OF WASHING UTENSILS

(75) Inventors: John W. Cantrell, Leawood, KS (US); John Inch, Kansas City, MO (US)

(73) Assignee: Metcraft, Inc., Grandview, MO (US)

( * ) Notice: Subject to any disclaimer, the term of this patent is extended or adjusted under 35 U.S.C. 154(b) by 0 days.

(21) Appl. No.: 10/724,486

(22) Filed: Nov. 26, 2003

(65) Prior Publication Data

US 2004/0107977 A1 Jun. 10, 2004

Related U.S. Application Data

(62) Division of application No. 09/947,485, filed on Sep. 6, 2001, now abandoned.

(51) Int. Cl.[7] ..... B08B 3/02
(52) U.S. Cl. ..... 134/25.2; 134/34
(58) Field of Search ..... 134/25.2, 25.3, 134/34; 211/41.8, 41.9, 181.1; 220/485–488, 494, 495, 600, 601, 660, 661

(56) References Cited

U.S. PATENT DOCUMENTS

| | | | | |
|---|---|---|---|---|
| 3,288,155 A | * | 11/1966 | Swetnam | 134/176 |
| 4,233,083 A | * | 11/1980 | Roberts | 134/25.2 |
| 5,069,360 A | * | 12/1991 | Dingler et al. | 220/501 |
| 5,287,984 A | * | 2/1994 | Michael | 220/812 |
| 5,927,309 A | * | 7/1999 | Hoover et al. | 134/195 |

* cited by examiner

*Primary Examiner*—Frankie L. Stinson
*Assistant Examiner*—Joseph L. Perrin
(74) *Attorney, Agent, or Firm*—Sonnenschein Nath & Rosenthal LLP

(57) ABSTRACT

A method of washing utensils in provided which provides a washing action of a pot and pan washing machine within an isolated portion of the washing machine. A utensil basket utilizing the method of the instant invention is also provided.

20 Claims, 1 Drawing Sheet

METHOD OF WASHING UTENSILS

CROSS REFERENCE TO RELATED APPLICATIONS

This is a divisional of U.S. application Ser. No. 09/947,485, filed Sep. 6, 2001, to Cantrell et al., which is incorporated herein by reference in its entirety, now abandoned.

FIELD OF THE INVENTION

The present invention relates to a utensil basket for use with a pot and pan washing machine. The present invention is a powered utensil basket, in that it captures a jet stream to maintain a washing action within the basket.

BACKGROUND OF THE INVENTION

Pot and pan washing machines, of the type used in restaurants, institutions and other eating facilities often involve a large wash tank or basin in which water is circulated about the pots and pans to provide a washing action. One such machine is described in U.S. Pat. No. 4,773,436 issued to Cantrell et al., the specification of which is incorporated herein by reference. The machine of Cantrell includes a wash tank with jets located at an elevated position along the rear wall of the wash tank. The tank is filled with water to a level above the position of the jets. Pots and pans are placed in the wash tank, and a pump is activated to draw water from within the wash tank and direct it through the jets to create a jet stream. Each jet directs its jet stream toward the bottom wall of the wash tank, the bottom wall then deflects the jet stream upward and towards the front wall of the tank. The front wall then deflects the upward moving jet stream towards the rear wall of the tank, and the rear wall deflects the jet stream downward and back towards the front wall along the bottom wall. The combination of deflections of the jet stream from the bottom, front and rear walls provides a rolling washing action within the wash tank.

Although a machine that employs a wash tank and jet stream of the type described above is extremely useful for washing pots and pans, it is less desirable for washing smaller items such as utensils. The wash tank is often of considerable depth making it difficult to retrieve utensils that have been loosely sprawled across the bottom of the tank. Also, the water within the wash tank is often left in the wash tank and reused for several loads, increasing the difficulty of retrieving small items from the bottom of the wash tank.

An alternative to sprawling utensils loosely across the bottom of the wash tank, is to contain the utensils within a utensil basket located within the wash tank. A utensil basket maintains all of the small items within a single area for easy retrieval upon completion of the washing cycle. Additionally, the utensil basket can be removable from the wash tank, further increasing the ease of emptying the utensils from the tank.

Although the use of prior art utensil baskets does allow for easy collection and removal of utensils from a wash-tank type washing machine, they do not efficiently utilize the full washing action of the jet stream. Prior art utensil baskets often comprise a wire mesh frame which can be mounted to or hung from a side of the wash tank. Being positioned along a side of the wash tank, and having indiscriminate dimensions, these prior art baskets only utilize a small portion of the washing action created by the jet stream thus decreasing the effectiveness of the machine in fully cleaning the utensils placed within the basket. Therefore, it is desirable to provide a utensil basket that more fully utilizes the washing action of the jet stream in a wash-tank type washing machine.

SUMMARY OF THE INVENTION

A principal object of the present invention is to provide an improved utensil basket for use in a wash-tank type washing machine. Another object of the present invention is to provide an improved utensil basket that utilizes a substantial portion of the washing action within a wash-tank type washing machine. It is yet another object of the present invention to provide an improved utensil basket that utilizes a substantial portion of the washing action within a wash-tank type washing machine by substantially capturing a jet stream within the utensil basket.

According to the above objects, the instant invention features an improved utensil basket for placement within the wash tank of a pot and pan washing machine. The basket comprises a bottom wall, a front wall, a rear wall, and two side walls. The walls are dimensioned to capture the jet stream within the utensil basket and to fully utilize the rolling washing action of the jet stream. The walls can be constructed of a substantially solid material that provides for deflection and containment of the jet stream, or, alternatively, the walls can be constructed of wire mesh and utilize the walls of the wash tank to provide for the deflection of the jet stream.

Whether the walls of the utensil basket are solid or mesh, their dimensions should correspond to the dimensions of the walls of the wash tank to fully utilize the same washing action as that created by deflection of the jet stream within the wash tank. Nevertheless, correspondence of wall dimensions is only important to the walls which are used to deflect the jet stream and provide the rolling wash action. For example, the utensil basket of the preferred embodiment is designed for the washing machine of U.S. Pat. No. 4,773,436. This washing machine utilizes the bottom, front and rear walls of the wash tank to deflect the jet stream and create the rolling action, it does not utilize the side walls of the tank for jet stream deflection. Thus, the dimensions of the bottom, front and rear walls of the utensil basket should correspond to dimensions of the bottom, front and rear walls of the wash tank, while correspondence between the dimensions of the side walls of the utensil basket and those of the wash tank are less important.

The utensil basket of the preferred embodiment utilizes walls that are substantially solid, thus, the deflection of the jet stream is provided by the basket walls rather than by the wash tank walls. The rear wall of the preferred embodiment includes an intake aperture for receiving the jet stream traveling in a first direction from a jet located on the rear wall of the wash tank. The bottom wall of the preferred embodiment includes a drain hole comprising perforations. The perforations are large enough to allow water to drain out of the utensil basket when the basket is removed from the wash tank, but small enough to allow a substantial amount of the jet stream to be deflected by the bottom wall of the basket. The substantially solid sidewalls of the preferred embodiment assist in containment of the jet stream by minimizing the amount of peel-off from the jet stream, thus resulting in a highly concentrated washing action within the utensil basket.

The jet stream enters the utensil basket at a predetermined angle and the jet stream is then deflected by the bottom wall upward and toward the front wall of the basket and so forth, in the same manner described above with respect to the deflection of the jet stream by the walls of the wash tank. These deflections of the jet stream create a washing action captured within the utensil basket which is virtually identical to the washing action within the wash tank.

As the predetermined angle of the jet stream is based upon the dimensions of the wash tank, the dimensions of the utensil basket should substantially correspond to the dimensions of the deflecting walls of the wash tank. It may be desirable to reduce the dimensions of the utensil basket, either for easier removal, or to intensify the wash action within the utensil basket. If either the length (distance from the rear wall to the front wall) or height (depth) of the basket is reduced from the dimensions of the wash tank, an appropriate reduction ratio should be employed to ensure preservation of the washing action.

For example the angle each of the nozzles in U.S. Pat. No. 4,773,436 is such that the jet stream will hit the bottom wall of the wash tank at a location near the front wall of the wash tank to allow the jet stream to deflect from the bottom wall, rise and circulate rearwardly from the front wall. Reduction of the basket depth (height) will alter the point of impact of the jet stream along the length of the basket, such that the distance from the rear wall to the point of impact along the length of the bottom will be reduced in proportion to the reduction of the depth. Thus simple geometry can be employed to determine the appropriate reduction ratio to use to maintain substantially the same angles of deflection within the utensil basket as are present within the wash tank.

The basket of the preferred embodiment captures the washing action created by a single jet of the washing machine. The basket can be positioned to utilize either one of the jets positioned along either side of the wash tank to maximize to amount of usable space available within the tank for washing pots and pans. Additionally, the utensil basket can be removably mounted within the wash tank to provide for ease of emptying and also to increase space within the wash tank for pots and pans when utensils are not being washed.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF THE PREFERRED EMBODIMENT

Preferred embodiments of the present invention are hereinafter described with reference to the accompanying drawings.

Figure 1:
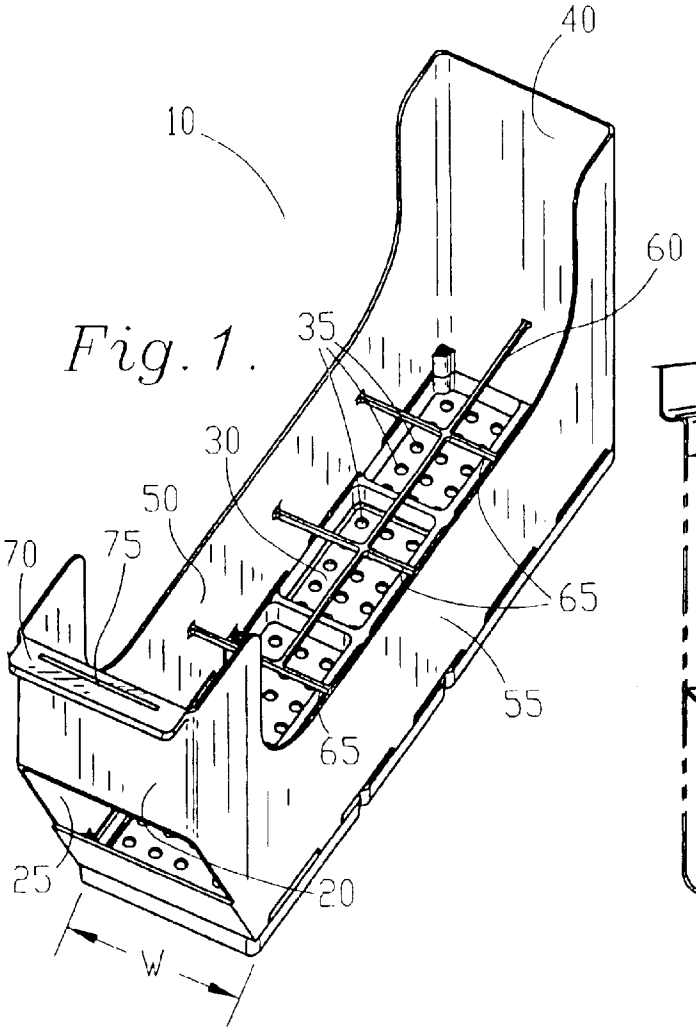
FIG. 1 is a perspective view from the rear side of the inventive utensil basket.

Referring to FIG. 1, a preferred embodiment of the inventive utensil basket for use in a wash-tank type washing machine is shown. Utensil basket 10 can be constructed of any suitable material such as stainless steel, or, for a lighter weight basket, a plastic material may be used. The preferred embodiment of utensil basket 10 includes an open top design having a base and four perimeter walls extending vertically from the base.

Base or bottom wall 30 is generally rectangular in shape and can be constructed as a single piece or as multiple segments joined together. Rear wall 20 extends vertically from a first end located along the perimeter of bottom wall 30. Front wall 40 extends vertically from a second end of the perimeter of bottom wall 30 opposite rear wall 20. Opposing side walls 50 and 55 extend vertically along opposing sides of the perimeter of bottom wall 30. Side walls 50 and 55 connect rear wall 20 to front wall 40.

Bottom wall 30 of the preferred embodiment is substantially solid, but includes a drain hole to permit water drainage out of basket 10. It is desirable to allow the water to easily drain from basket 10 when the basket is removed from the wash tank, or when the water in the wash tank is emptied. As is shown in FIG. 1, the drain hole of the preferred embodiment consists of a series of holes or perforations through bottom wall 30. Perforations 35 are of appropriate size and location to permit adequate drainage of basket 10 while simultaneously allowing bottom wall 30 to deflect a substantial portion of the jet stream and capture the rolling wash action of the washing machine within basket 10.

Figure 2:
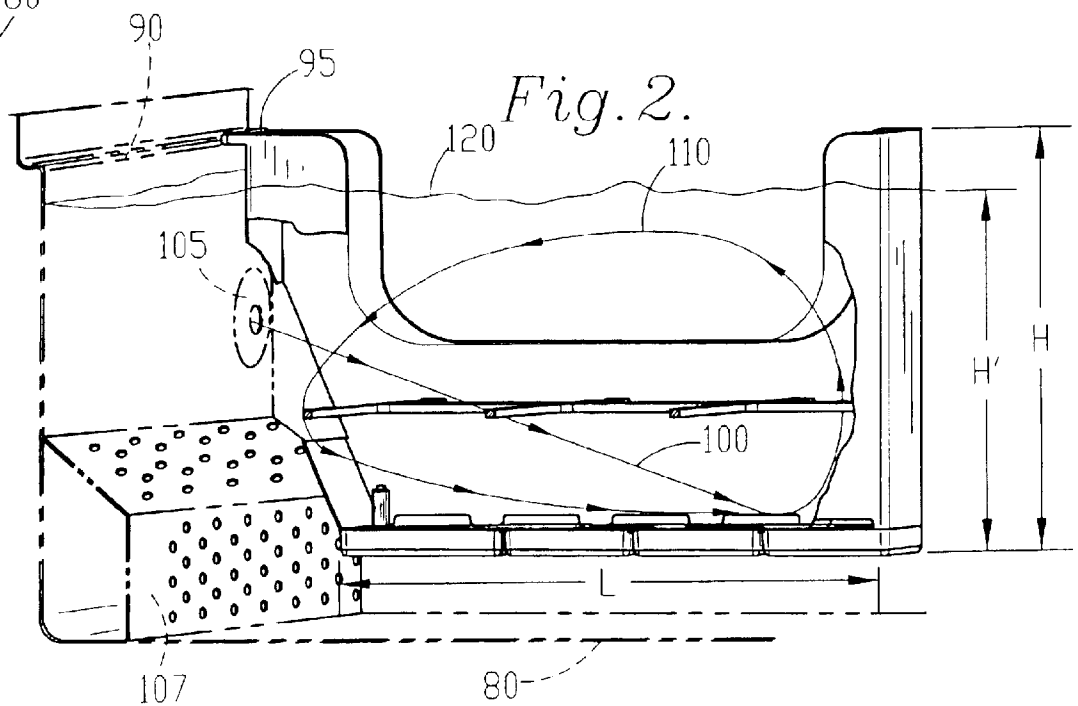
FIG. 2 is a partial cutaway perspective side view of the inventive utensil basket mounted within a wash tank.

Rear wall 20 extends vertically in a direction substantially perpendicular to base 30. As is shown in FIG. 2, the lower portion of rear wall 20 is slightly angled to conform to the contour of the rear wall of the wash tank for which the basket has been designed. The upper portion of rear wall 20 includes inlet aperture 25. Mounting flange 70 extends horizontally in a substantially perpendicular direction from rear wall 20. Slit 75 extends vertically through mounting flange 70 in a direction substantially perpendicular to flange 70.

Front wall 40 is solid and extends vertically in a direction substantially perpendicular to base 30 to conform to the contour of the front wall of the wash tank for which basket 10 has been designed. Opposing side walls 50 and 55 are solid and extend vertically in a direction substantially perpendicular to base 30. Horizontal cross-member 60 extends between front wall 40 and rear wall 20. Horizontal cross-members 65 extend between side walls 50 and 55. Cross-members 60 and 65 divide basket 10 into multiple compartments to allow for support and separation of utensils placed within the basket. The cross-members are constructed to have a substantially small cross-section to prevent deflection of the jet stream by the cross-members. The cross-members can be permanently connected to the walls of basket 10, or they can be made removable and adjustable to allow for manipulation of compartment sizes and shapes.

FIG. 2 shows utensil basket 10 mounted within wash tank 80, shown partially cut-away. Side wall 55 of utensil basket 10 has been partially cut-away in FIG. 2 to show the directions of jet stream 100 and wash action 110 within basket 10.

The top portion of the rear wall of wash tank 80 includes horizontally extending groove 90 for receiving mounting flange 70 of basket 10. Vertical rib 95 extends perpendicular to flange 70 for engagement with slit 75. Basket 10 is releasably mounted within the wash tank through the use of mount 70, groove 90, rib 95, and slit 75. Basket 10 is placed within tank 80, mounting flange 70 rests on horizontal groove 90, and rib 95 extends through slit 75 to prevent movement of the basket along horizontal groove 90. Rear wall 20 of basket 10 is contoured to the shape of the rear wall of tank 80 such that rear wall 20 fits snugly against the rear wall of the wash tank to support the weight of basket 10. In the preferred embodiment, the lower portion of rear wall 20 of utensil basket 10 is slightly angled to conform to the contour of intake grate 107 located along the lower portion of rear wall 20. Intake grate 107 is the subject of U.S. patent application Ser. No. 09/947,484 filed on Sep. 6, 2001, the specification of which is incorporated herein by reference.

In operation, tank 80 is filled with water and a cleaning agent. Operating water level 120 is preferably above the top of nozzle 105. When basket 10 is correctly mounted within wash tank 80, intake aperture 25 will correspond to nozzle 105. Water is drawn from wash tank 80 through intake grate 107 by a pump. The pump then expels the water through nozzle 105 to create jet stream 100. Nozzle 105 is angled to direct jet stream 100 through inlet aperture 25, into basket 10, and toward the front portion of bottom wall 30. Bottom wall 30 then deflects jet stream 100 upward and towards front wall 40. Front wall 40 then deflects the upward moving jet stream towards rear wall 20 of the basket, and the rear wall deflects the jet stream downward and back towards the front wall along bottom wall 30. The combination of deflections of the jet stream from the bottom, front and rear walls provides a rolling, washing action 110 within utensil basket 10, this wash action is essentially identical to the wash action described with respect to the washing machine of U.S. Pat. No. 4,773,436.

Length L of basket 10 corresponds to the length between the front and rear walls of the wash tank, and height H of the front and rear walls of the basket corresponds to the height of the wash tank. Width W is governed by the size of nozzle 105 and by the amount of wash action that is desired to be captured within basket 10. Width W of the basket can be increased to encompass multiple nozzles within the wash tank if increased wash action is desired.

It may be desirable to reduce the overall size of the utensil basket for several reasons. First of all, using the same dimensions as the wash tank may be too cumbersome for a removable basket, and also take up more space within the tank than necessary to wash utensils. Additionally, reduction of the dimensions of basket 10 will result in increasing the intensity of the jet stream as it travels through the basket along the path of wash action 110.

Length L and height H of basket 10 do not have to be identical to the length and height of wash tank 80; however, it is preferred that the dimensions correspond to each other to ensure that the wash action within basket 10 is virtually identical to the wash action of the washing machine. For example, note that utensil basket 10 does not rest on the bottom wall of wash tank 80, making submersion height H' of the portion of basket 10 below water level 120 less than the height of the portion of the wash tank below water level 120. Therefore, in the preferred embodiment, length L of the utensil basket will be proportionally reduced using a reduction ratio to maintain the same angles of deflection of jet stream 100 within utensil basket 10 as are present in the wash tank.

The reduction ratio is determined by simple geometry based upon the angle of impact of jet stream 100 with bottom wall 30. The reduction ratio can be a direct proportion, whereby as submersion height H' is reduced by a given percentage, length L will be reduced by the same percentage. Alternatively, the reduction ratio may be more complex, taking into account the effects of the increased intensity of the impact of jet stream 100 with the walls of basket 10. For example, as submersion height H' is reduced, the point of impact of jet stream 100 with bottom wall 30 will become increasing closer to nozzle 105. The closer the point of impact to the nozzle, the greater the amount of energy, or higher the intensity, of jet stream 100. This increased intensity may result in undesirable splashing or overflow of the jet stream from the utensil basket due to the angles of deflection. Thus, it may be desirable to adjust some of the deflection angles within basket 10 while still maintaining the rolling effect of wash action 110.

The height of sidewalls 50 and 55 is not as important to the proper deflection of the jet stream within the utensil basket of the preferred embodiment as the other dimensions discussed above. Nevertheless, it is preferred that the height of the sidewalls be such that water level 120 will be above the top of side walls 50 and 55. This will allow water to peel over the top of side walls 50 and 55 as water is forced into basket 10 by nozzle 105 thereby maintaining an equal water level throughout the wash tank and the utensil basket.

As the jet stream moves through the water that is already present in the utensil basket, portions of the jet stream will tend to peel off into the surround fluid, reducing the effectiveness of the wash action. The use of solid sidewalls assists in containment of the jet stream. Width W of the utensil basket can be varied to provide the desired amount of restriction of the jet stream within basket 10. Reducing width W will function to guide the jet stream along a more confined path, significantly decreasing the peeling off of the jet stream into the surrounding fluid.

In the foregoing description, certain terms have been used for brevity, clearness and understanding, but no unnecessary limitations are to be implied therefrom beyond the requirements of the prior art, because such terms are used for descriptive purposes and are intended to be broadly construed. Moreover, the description and illustration of the inventions is by way of example, and the scope of the invention is not limited to the exact details shown or described.

Certain changes may be made in embodying the above invention and in the construction thereof, without departing from the spirit and scope of the invention. It is intended that all matter contained in the above description and shown in the accompanying drawings shall be interpreted as illustrative and not meant in a limiting sense.

Although the powered utensil basket of the instant invention has been described and shown in association with a pot and pan washing machine having jets located along the rear wall of the wash tank, the scope of invention is not intended to be so limited. The jets of the wash tank could be located along any single wall, or along multiple walls. In such instances the dimensions of the utensil basket would be reconfigured to appropriately capture the wash action created by the jet stream. Additionally, the jet stream of the instant invention may be deflected in a manner other than that described herein. The walls from which the jet stream may be deflected is not absolutely decisive of the invention, so long as the essence of capturing a wash action within the utensil basket is maintained.

The inlet aperture can be located within any wall of the utensil basket, or even through the open top, to correspond to the location of the jet nozzles within the wash tank. A top wall can also be included on the utensil basket, if desired.

While the preferred embodiment shows the use of a mount to attach the utensil basket to the wash tank, the basket may be merely placed with the wash tank without the use of any mount, so long as appropriate dimensions are utilized to capture the jet stream. Additionally, alternative mounts may be developed to appropriately attach the basket to the wash tank.

Having now described the features, discoveries and principles of the invention, the manner in which the inventive utensil basket is constructed and used, the characteristics of the construction, and advantageous, new and useful results obtained, the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

Having thus described the invention, what is claimed as new and desired to be secured by Letters Patent is as follows:

1. A method of washing utensils in a pot and pan washing machine, the pot and pan washing machine including a wash tank, the wash tank including a plurality of nozzles each supplying a jet stream of water within the wash tank, each jet stream deflecting from at least one wall of the wash tank to provide a washing action, said method comprising the steps of:

isolating a portion of the wash tank wherein at least one of the plurality of nozzles is located in said isolated portion of the wash tank and at least one other of the plurality of nozzles is located in a non-isolated portion of the wash tank; and capturing at least a substantial portion of the jet stream from the at least one of the plurality of nozzles within said isolated portion of the wash tank while at least substantially maintaining the jet stream deflection of the washing machine to provide a washing action within said isolated portion of the wash tank.

2. The method as claimed in claim 1 wherein said step of isolating a portion of the wash tank further comprises the step of positioning a utensil basket in the wash tank.

3. The method as claimed in claim 2 further comprising the step of deflecting the jet stream from the at least one of the plurality of nozzles within said isolated portion of the wash tank from at least one wall of said utensil basket to provide the washing action within said utensil basket.

4. The method as claimed in claim 3 wherein said utensil basket comprises:

a bottom wall including an outer perimeter;

a rear wall extending in a direction substantially perpendicular to said bottom wall, said rear wall located substantially at a first end of said perimeter;

a front wall extending in a direction substantially perpendicular to said bottom wall, said front wall located substantially at a second end of said perimeter, said second end opposing said first end;

two side walls extending in a direction substantially perpendicular to said bottom wall and substantially perpendicular to said front and rear walls, said side walls substantially located at opposing sides of said perimeter; and wherein said basket is dimensioned to utilize the washing action of the washing machine by maintaining proper deflection of the jet stream from the at least one of the plurality of nozzles within said isolated portion of the wash tank and to capture a substantial portion of the jet stream within said utensil basket.

5. The method as claimed in claim 4 wherein said utensil basket further comprises a mount for releasably securing said utensil basket to a wall of the wash tank.

6. The method as claimed in claim 5 wherein said mount comprises a flange extending in a horizontal direction substantially perpendicular to said rear wall, said flange adapted to engage with a horizontal groove located on the wall of the washing machine.

7. The method as claimed in claim 6 wherein said mount further comprises a slit extending through said flange in a direction substantially perpendicular to said horizontal direction of said flange, said slit adapted to receive a rib extending from said groove in a direction substantially perpendicular to said groove.

8. The method as claimed in claim 4 further comprising an inlet aperture through said rear wall adapted to receive the jet stream emanating from the at least one of the plurality of nozzles within said isolated portion of the wash tank.

9. The method as claimed in claim 4 wherein said bottom wall is substantially solid.

10. The method as claimed in claim 9 further comprising a drain hole through said bottom wall.

11. The method as claimed in claim 10 wherein said drain hole comprises perforations in said bottom wall.

12. The method as claimed in claim 4 further comprising at least one horizontal cross-member extending between said side walls or between said front and rear walls to divide said utensil basket into multiple compartments.

13. The method as claimed in claim 3 wherein said utensil basket comprises:

a bottom wall including an outer perimeter;

a rear wall extending in a direction substantially perpendicular to said bottom wall, said rear wall located substantially at a first end of said perimeter, said rear wall including an inlet aperture for receiving jet steam from the at least one of the plurality of nozzles within said isolated portion of the wash tank traveling in a first stream direction;

a front wall extending in a direction substantially perpendicular to said bottom wall, said front wall located substantially at a second end of said perimeter, said second end opposing said first end;

two side walls extending in a direction substantially perpendicular to said bottom wall and substantially perpendicular to said front and rear walls, said side walls substantially located at opposing sides of said perimeter.

14. The method as claimed in claim 13 further comprising a mount for releasably securing said utensil basket to a wall of the washing machine.

15. The method as claimed in claim 14 wherein said mount comprises a flange extending in a horizontal direction substantially perpendicular to said rear wall, said flange adapted to engage with a horizontal groove located on the wall of the wash tank.

16. The method as claimed in claim 15 wherein said mount further comprises a slit extending through said flange in a direction substantially perpendicular to said horizontal direction of said flange, said slit adapted to receive a flange extending from said groove in a direction substantially perpendicular to said groove.

17. The method as claimed in claim 13 wherein said bottom wall is substantially solid for diverting the jet stream from a first stream direction to a second stream direction.

18. The method as claimed in claim 17 further comprising a drain hole through said bottom wall.

19. The method as claimed in claim 18 wherein said drain hole comprises perforations in said bottom wall.

20. The method as claimed in claim 13 further comprising at least one horizontal cross-member extending between said side walls to divide said utensil basket into multiple compartments.

* * * * *